United States Patent [19]

Nakamura

[11] 4,059,266

[45] Nov. 22, 1977

[54] GAME MACHINE

[75] Inventor: Masaya Nakamura, Tokyo, Japan

[73] Assignee: Kabushiki Kaisha Nakamura Seisakusho, Tokyo, Japan

[21] Appl. No.: 743,065

[22] Filed: Nov. 18, 1976

[30] Foreign Application Priority Data

June 3, 1976 Japan ..... 51-64059
June 7, 1976 Japan ..... 51-65610

[51] Int. Cl.[2] ..... A63F 9/14
[52] U.S. Cl. ..... 273/1 E; 35/11 R
[58] Field of Search ..... 273/1 E; 272/31 R; 35/11 R

[56] References Cited

U.S. PATENT DOCUMENTS

| | | | |
|---|---|---|---|
| 3,568,332 | 3/1971 | Koci et al. | 273/1 E X |
| 3,575,413 | 4/1971 | Furukawa et al. | 273/1 E |
| 3,583,079 | 6/1971 | Koci | 35/11 R |
| 3,657,457 | 4/1972 | Poynter | 35/11 R |
| 3,690,657 | 9/1972 | Nakamura | 273/1 E |
| 3,734,497 | 5/1973 | Brown | 273/1 E |

FOREIGN PATENT DOCUMENTS

| | | | |
|---|---|---|---|
| 1,422,273 | 11/1968 | Germany | 35/11 R |

*Primary Examiner*—Paul E. Shapiro
*Attorney, Agent, or Firm*—Toren, McGeady and Stanger

[57] ABSTRACT

A machine adapted to produce on a screen images of a road and motor vehicles, not under the control of an operator of the machine, which run over the road while changing lanes thereover. An illusion of motor vehicles changing lanes while running over the road can be created by the relative movement of a road image forming means represented on a rotary disk and motor vehicle models supported by a rotary body, such relative movement taking place across the width of the road forming means.

10 Claims, 8 Drawing Figures

GAME MACHINE

BACKGROUND OF THE INVENTION

This invention relates to game machines, and more particularly to a game machine wherein images of a road and motor vehicles running thereover can be formed on a screen.

One form of the game machine of the type described known in the art comprises a plurality of transparent or semitransparent disks having thereon pictorially represented images of a road and motor vehicles and arranged in parallel juxtaposed relation for rotation relative to one another, a light source for projecting images of the pictorially represented images on a screen.

One form of the game machine of the type described known in the art comprises a plurality of transparent or semitransparent disks having thereon pictorial representations of a road and motor vehicles and arranged parallel to one another for relative rotation, a light source projecting images of the pictorial representations of the road and the motor vehicles on a screen, and means for driving the disks to cause them to rotate. In this type of game machine, a proposal has been made to render oscillatable a unit consisting of the disks and the drive means therefor, such oscillating movements of the unit being controllable from outside, so that an illusion of the motor vehicle images banking on the road can be created on the screen (U.S. Pat. No. 3,767,196).

In the game machine of the type described, the images of motor vehicles not controlled by the operator run along the same courses over the circular road at all times. As a result, the illusion of simulated vehicle images running over the road created on the screen somewhat lacks reality and consequently the operator's interest lessens. This is conducive to reduced value of the game machine.

SUMMARY OF THE INVENTION

Accordingly, a main object of the invention is to provide a game machine wherein the motor vehicle images formed on the screen, not under the control of an operator of the machine, behave as if they are actually changing lanes on the road.

Another object of the invention is to provide a game machine which permits an image of a road to be created on the screen in a manner such that the road is wound or curved in different curvatures at different portions thereof.

According to the invention, there is provided a game machine wherein images of a road and motor vehicles running thereover can be formed on a screen, such game machine comprising a rotary body fixedly supporting at least one motor vehicle model, a background scenery disk arranged coaxially with the rotary body and spaced axially therefrom for rotation independently of the rotary body, a transparent road image forming means represented on the background scenery disk and surrounding the center of rotation of the disk in a closed loop, the road image forming means being non-circular in shape, a screen, a light source for projecting on the screen the images road represented on the disk and of motor vehicle models, and drive means for rotating the disk and the rotary body.

According to the invention, there is also provided a game machine wherein images of a road and motor vehicles running thereover can be formed on a screen, comprising, a rotary body supporting at least one motor vehicle model, a background scenery disk arranged coaxially with said rotary body and spaced axially therefrom for rotation independently of the rotary member, a transparent road image forming means represented on the background scenery disk and surrounding the center of rotation of the disk in a closed loop, means for moving the motor vehicle models supported by the rotary body relative to one another widthwise of the road image forming means, a screen, a light source for projecting on the screen the images of road represented on the disk and of the motor vehicle models, and drive means for rotating the disk and the rotary body.

Additional and other objects and advantages of the invention will become apparent from the description set forth hereinafter when considered in conjunction with the accompanying drawings.

DESCRIPTION OF THE PREFERRED EMBODIMENT

A preferred embodiment of the invention will be described with reference to the drawings.

Figure 1:
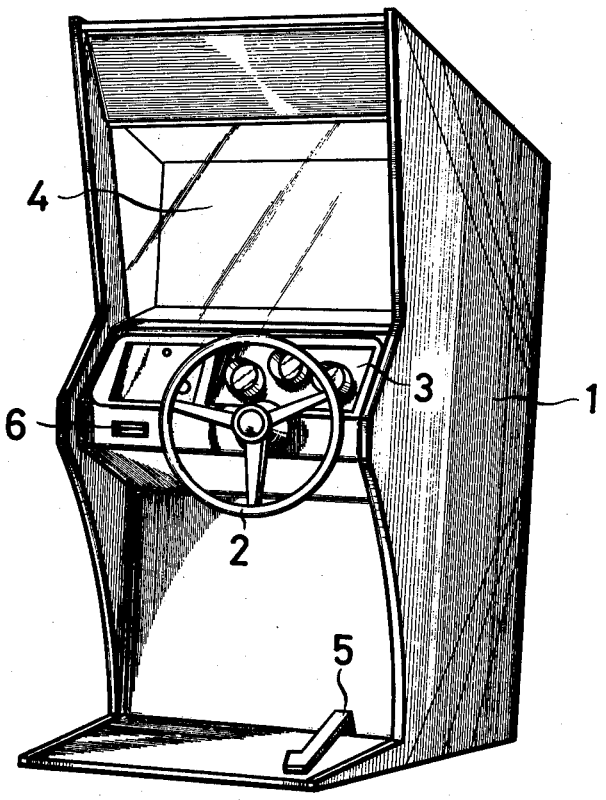
FIG. 1 is a perspective view of the game machine comprising one embodiment of the present invention.

Referring to FIG. 1, the reference numeral 1 generally designates a game machine according to the invention which has a front portion presenting the appearance of a driver's seat and comprising a steering wheel 2, an instrument panel 3, a wind shield 4 and an accelerator 5. The numeral 6 denotes a coin inserting slot.

Figure 2:
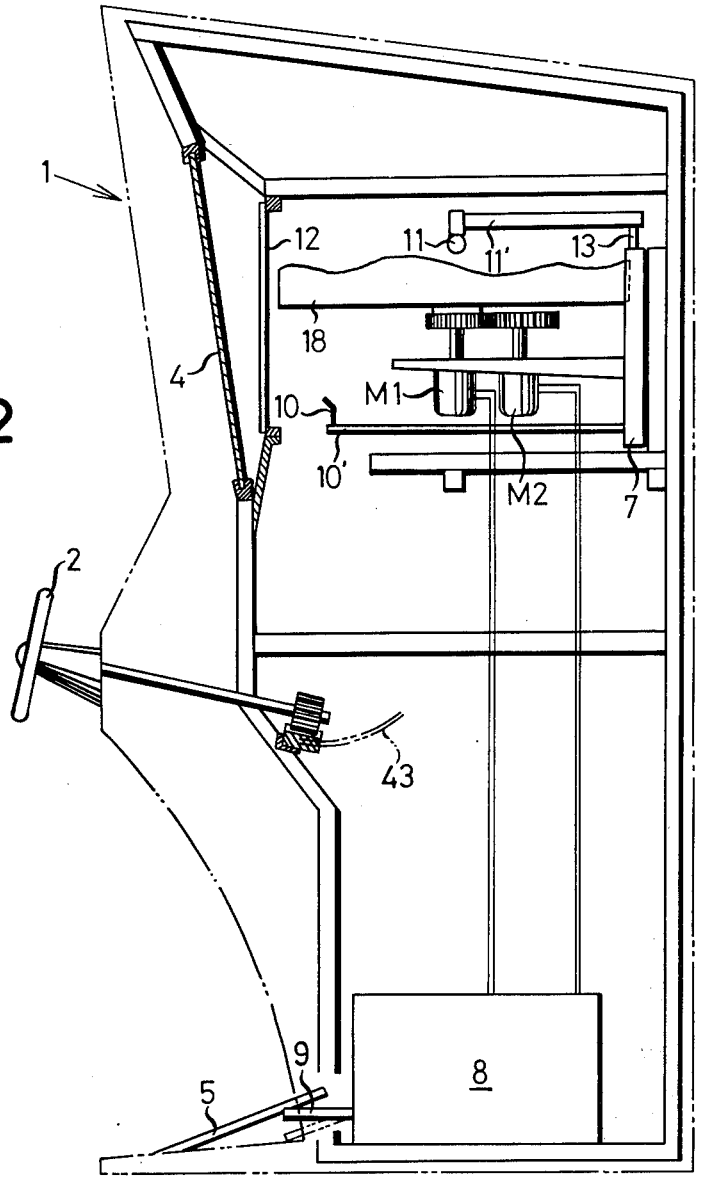
FIG. 2 is a schematic view showing the interior of the casing of the game machine shown in FIG. 1.

Referring to FIG. 2, a frame 7 for supporting an unitary structure is pivotally supported within a casing of the game machine. The frame 7 supports a background scenery disk 18 and a motor vehicle model supporting rotary body 30 (See FIGS. 3 and 4) for relative rotary movements independent of each other. The numeral 8 designates a control means which is operated through a lever 9 for controlling motors $M_1$ and $M_2$ secured to the frame 7. The numeral 10 designates a motor vehicle model supported at the front end of a lever 10' and projected on a screen 12 by a light source 11 as a forward portion of the vehicle driven by the operator. The vehicle model 10 may be either a two-dimensional model painted on a transparent plate in semitransparent ink or a three-dimensional model. The lever 10' supporting the motor vehicle model 10 and a lever 11' for supporting the light source 11 are disposed one above the other under in spaced relationship and secured to a common rotary shaft 13 disposed in the rear portion of the casing.

Figure 3:
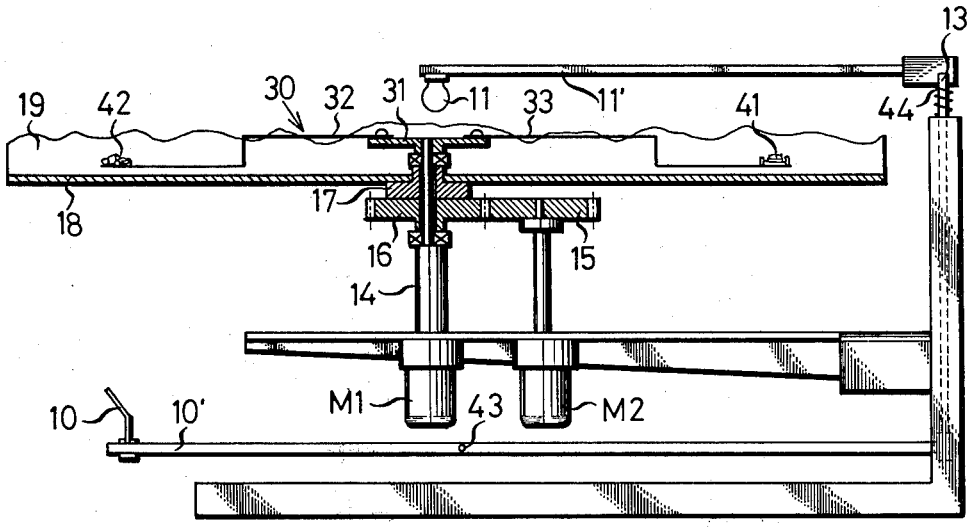
FIG. 3 is a fragmentary sectional view, on an enlarged scale, of the unitary structure comprising a rotary body, a background scenery disk and drive means therfor.
Figure 4:
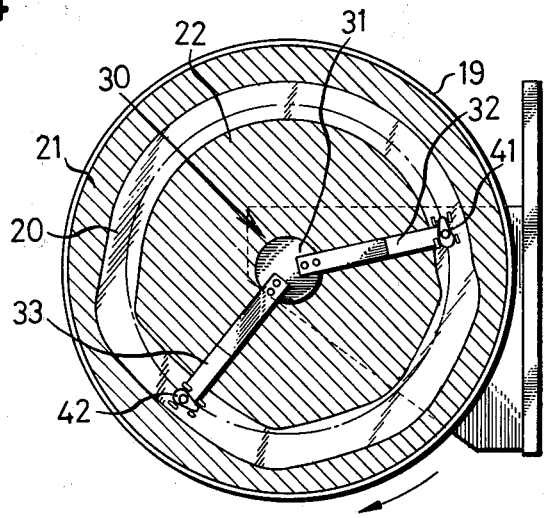
FIG. 4 is a top plan view of the rotary section of the unitary structure shown in FIG. 3, displays one form of motor vehicle supporting rotary body.

Referring to FIG. 3, the numeral 14 designates a rotary shaft driven for rotation by motor $M_1$ and supporting, through a thrust bearing, a gear 16.

Disposed over the gear 16 and supported by the rotary shaft is a hub 17 of the background scenery disk 18 which is also rotated by the rotary shaft 14. The background scenery disk 18 is driven by motor $M_2$ through gears 15 and 16 for rotation in the direction of an arrow, for example, shown in FIG. 4. The background scenery disk 18 is provided with a non-circular or curved transparent road image forming means 20 in the form of a closed loop disposed around the center of rotation of the disk 18, and background scenery sections 21 and 22 disposed on opposite sides of the road image forming means 20. The background scenery disk 18 also includes an upstanding mountain-shaped wall portion 19 disposed vertically on the rim of disk 18. These portions 19 to 20 are colored transparencies. The elements 19 to 20 are projected by the light source 11 and form on the screen 12 images of distant mountains 119, a curved road 120 and the background scenery 121 and 122 disposed on opposite sides of the road 120.

Secured to the rotary shaft 14 through a thrust bearing and disposed over the hub 17 of the background scenery disk 18 is a rotary member 31 for a motor vehicle model supporting rotary body 30 which has secured thereto a plurality of transparent motor vehicle support members 32 and 33 which in turn support motor vehicle models 41 and 42, respectively, at the forward end thereof. Thus the two support members 32 and 33 rotate as the shaft 14 rotates. This causes the motor vehicle models 41 and 42 to move along a circular path shown in a dash-and-dot line. The aforementioned curved road image forming means 20 may be curved in any way as desired other than a circular shape, so long as the path of movement of the motor vehicle models is disposed within the road image forming means 20 and does not deviate widthwise therefrom. It is to be understood that the motor vehicle models 41 and 42 need not necessarily be arranged to move along the same path, and that they may move along different paths, so long as the plurality of paths followed by the motor vehicle models remain within the road image forming means without deviating widthwise therefrom.

Figure 8:
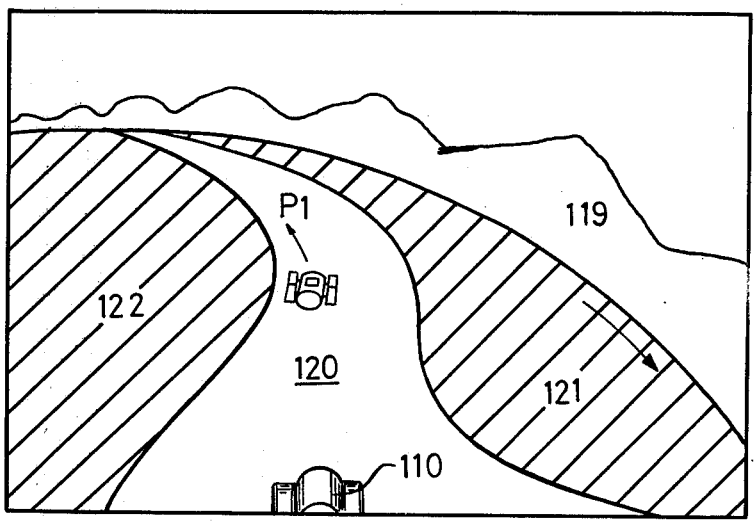
FIG. 8 is a view showing the images of motor vehicles, road and scenery formed on the screen.

In operation, insertion of a coin 6 through the coin inserting slot 6 shown in FIG. 1 causes a current to be passed to the drive motor $M_1$ and light source 11, thus causing the motor vehicle model supporting rotary body 30 to rotate. As a result, the three-dimensional motor vehicle models 41 and 42 supported by the support members 32 and 33 respectively also rotate. Since the background disk 18 remains stationary at this time, the motor vehicle models 41 and 42 are projected on the screen 12 to form images thereof which run on a road in the direction of an arrow $P_1$ in FIG. 8.

Upon the accelerator 5 shown in FIGS. 1 and 2 being depressed by the operator, a current is passed to the drive motor $M_2$ by closing a switch (not shown), so that the background scenery disk 18 rotates. As a result, images of the road 120, the scenery 121, 122 and the distant mountains 119 move on the screen 12. This creates an illusion that the motor vehicle driven by the player runs on the screen 12 as the image 110 of the motor vehicle model 10 driven by the operator travels over the road on the screen. The control means 8 operates such that it controls the direction of rotation and the number of revolutions of the motor $M_1$ and the number of revolutions of the motor $M_2$, depending on the force with which the accelerator 5 is depressed. By the operation of the control means 8, the speed of rotation of the background scenery disk 18 and the speed of the traveling vehicle models 41 and 42 can be varied, thereby creating the illusion of the operator's vehicle and other vehicles traveling over the road at different speeds. When the motor vehicle model disk 18 is made to rotate in a direction opposite to the direction of movement of the motor vehicle model support members 32 and 33, there is created on the screen 12 the scene that the images of the motor vehicle driven by the operator is outrun by the images of other motor vehicles.

If the operator operates the steering wheel 2, the motor vehicle model support lever 10' and the light source support lever 10 can be moved through a wire 43 (See FIG. 1) and a return spring 44 against or by virtue of the biasing force of the spring 44. This achieves the effect of the motor vehicle model under the control of the operator moving to the left or right of the image of the road 120 on the screen 12. The motor vehicle model 10 has three light receiving elements arranged in spaced relation widthwise of the road forming image means 20. The light receiving elements consist of a head-on collision detecting element disposed in the middle and detector elements disposed on opposite sides of the head-on collision detecting element. The road image forming means 20 is made of a transparent material and has a width which is greater than the spacing between the two oppositely disposed detector elements. However, the road image forming means 20 is curved in a manner such that the paths of movement of the motor vehicle models do not deviate widthwise and stick out of the image of the road 120 on the screen 12. Thus the image of the motor vehicle not under the control of the operator, travels on the image of the road 120 which is curved in different curvatures at different portions thereof, so that the images of motor vehicles, not under the control of the operator, are formed on the screen 12 as if they were changing lanes on the road. The operator can feel as if he were actually driving a car over the road due to the bends provided in different parts of the image of the road 120 and the presence of the vehicle images changing lanes on the screen 12. It will be appreciated that the operator can really amuse himself because of the reality of the motor trip he can enjoy by this game machine.

This machine is very attractive as can be seen from the foregoing description. Moreover, the machine is advantageous in that it is simple in construction, low in cost and long in service life.

Figure 5:
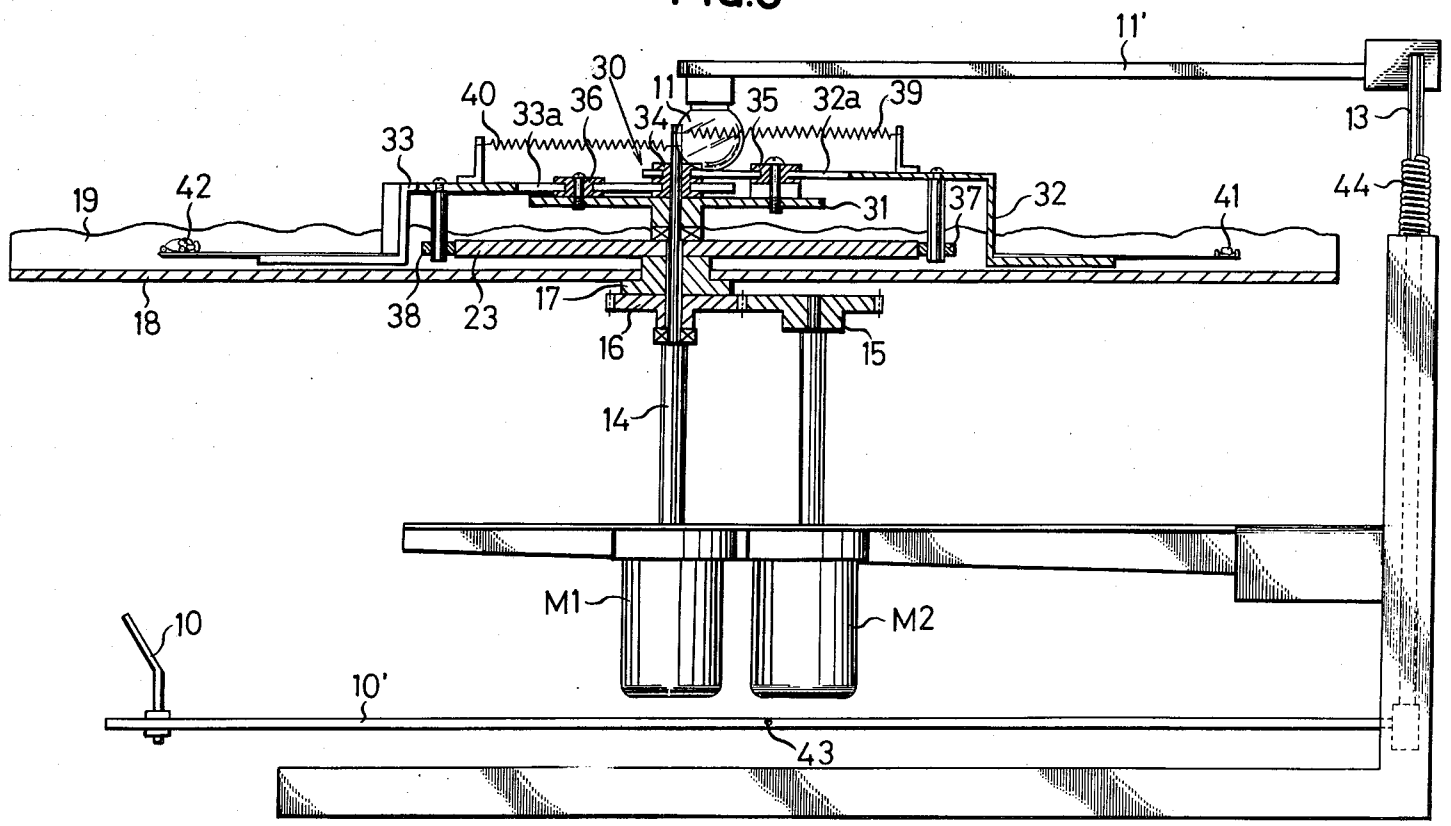
FIG. 5 is a fragmentary sectional view, on an enlarged scale, illustrating an alternative device of the unitary structure shown in FIG. 3.
Figure 6:
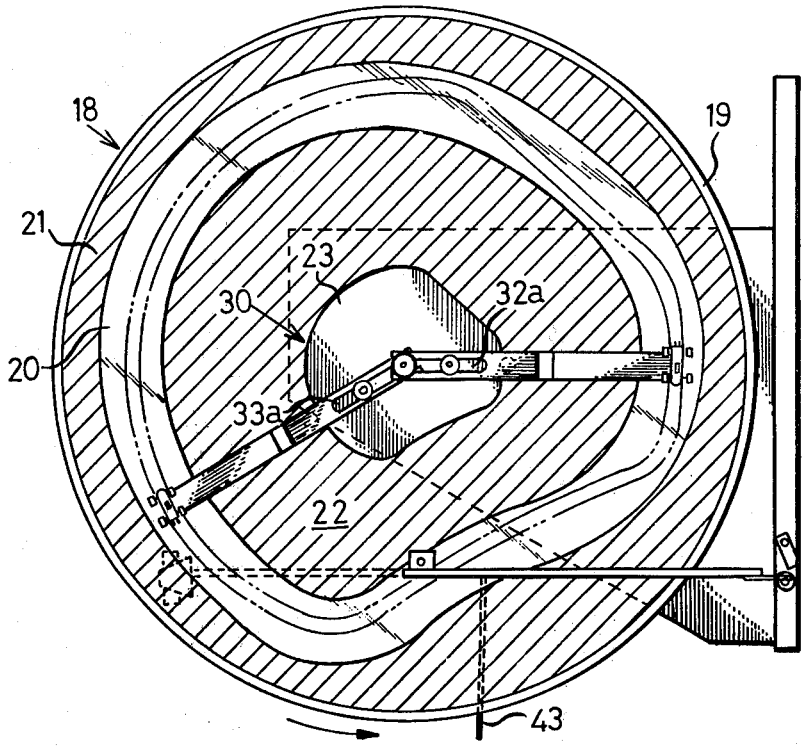
FIG. 6 is a top plan view of the rotary section of the unitary structure shown in FIG. 5, showing another form of motor vehicle supporting rotary body.

FIG. 5 and FIG. 6 show an alternative device for mounting the motor vehicle model support members 32 and 33 wherein such members can change their positions radially of the rotary member 31 while the latter is rotating. As shown, a cam plate 23 is disposed over the hub 17 of the background scenery disk 18 and supported by the rotary shaft 14 for rotation relative to the shaft 14. The cam plate 23 has a cam surface which, as shown in FIG. 6, in non-circular and not similar in shape to the road image forming means 20, and rotates with the background scenery disk 18 as a unit. It is to be understood that the cam plate 23 may be similar in shape to the road image forming means 20. The rotary member 31 for the motor vehicle model supporting rotary body is disposed over the cam plate 23 and secured to the rotary shaft 14 through a thrust bearing. The rotary member 31 has mounted thereon the motor vehicle model support members 32 and 33 having fixed to their forward ends the three-dimensional motor vehicle models 41 and 42 respectively and slidably movable radially of the rotary shaft 14 with respect to the rotary member 31 but immovable peripherally thereof.

The motor vehicle model support members 32 and 33 are formed at their bases with slots or cutouts 32*a* and 33*a*, respectively, which loosely engage grooves formed one above the other on the periphery of a central guide 34 fixed to the rotary shaft 14. The rotary member 31 is formed thereon with intermediate guides 35 and 36 which are disposed in diametrically opposed positions and which are spaced equidistantly from the central guide 34. The intermediate guides 35 and 36 are formed on their peripheries with grooves which are disposed at the same height as one of the grooves formed in the central guide 34 and which are loosely engaged by the cutouts 32*a* and 33*a* formed in the motor vehicle model support members 32 and 33. Thus, the two motor vehicle model support members 32 and 33 are supported such that they are disposed in spaced parallel relationship and capable of moving back and forth radially of the rotary support 31 as guided by the central support 34 and intermediate supports 35 and 36.

The motor vehicle model support members 32 and 33 are provided, at their lower surfaces, with cam followers 37 and 38 respectively, by which the cam plate 23 is tracked. Springs 39 and 40 are mounted between upstanding posts on the upper surfaces of the support members 32 and 33 and the rotary shaft 14, so that the support members 32 and 33 are urged to move by the biasing force of the springs 39 and 40 toward the rotary shaft 14. By this arrangement, the motor vehicle model support members 32 and 33 and the motor vehicle models 41 and 42 supported thereby are disposed in positions which vary depending on the shape of the cam plate 23. By rotating the rotary support 31 relative to the cam plate 23, the positions of the motor vehicle models 41 and 42 can be changed in accordance with the cam profile of the cam plate 23. The width and shape of the road image forming means 20 is decided such that the motor vehicle models 41 and 42 change their positions within the road image forming means 20. Thus the road image forming means 20 on the background scenery disk 18 may be circular or non-circular in shape so long as the motor vehicle models 41 and 42 travel on the road image forming means 20. Conversely, the profile of the cam plate 23 can be varied as desired so long as the motor vehicle models 41 and 42 stay on the road image forming means 20 without being forced out of it.

In this alternative device, the road image forming means 20 on the background scenery disk 18 is curved in a manner such that its curvature conforms to the cam profile of the cam plate 23. When projected on the screen 12, the road image forming means 20 forms the image of the road 120 which has different curvatures at different portions thereof. This gives reality to the illusion of the images of the road and motor vehicle travelling thereover, so that the operator feels as if he were actually driving a car on the road and his interest in the game is increased. By arranging the motor vehicle models 41 and 42 as aforementioned, it is possible to cause their images to travel on the screen 12 along the images of a road which is more complicated than the images of the road 120 formed by the mechnism shown in FIG. 3. Thus the operator feels as if he were actually driving a car and the simulated steering wheel 2 should be operated in a manner such that the image of the vehicle under the control of the operator does not collide against the images of other vehicle models.

Figure 7:
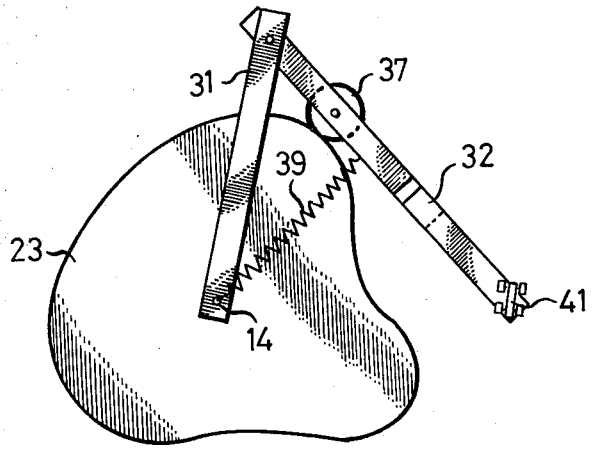
FIG. 7 is a plan view showing still another form of motor vehicle supporting rotary body.

FIG. 7 shows still another alternative device for mounting the motor vehicle model support members 32 and 33 by means of the motor vehicle model support rotary body 30. In the interest of brevity, there is only shown the motor vehicle model 41. However, two or more vehicle models may be mounted as in the devices described previously. In this mounting device, the center of rotation of the motor vehicle model support member 32 is not disposed in the rotary shaft 14 but disposed in a position away from the rotary shaft 14. More specifically, the support member 31 is pivotally connected at its rear end portion to an outer portion of the rotary support 31 fixed to the rotary shaft 14 at its inner portion. A cam follower 37, which is fixed to the support member 32, is maintained in engagement with the cam surface of the cam plate 23 by the biasing force of a spring 39 mounted between the support member 31 and the rotary shaft 14. By supporting the center of rotation of the motor vehicle model support member 32 in a position which is displaced from the rotary shaft 14, it is possible to cause the motor vehicle model 41 to travel in a more complicated pattern of movement. This enables the image of the motor vehicle model 41 appearing on the screen to move in a realistic manner when traveling along a curved part of the image of the road, making the operator feel as if he were actually driving his car.

It is to be understood that the motor vehicle models 41 and 42 are not limited to three-dimensional models, and that they may be in a two-dimensional form, such as pictorial representations of motor vehicles.

What I claim is:

1. A game machine wherein images of a road and motor vehicles running thereover can be formed on a screen, comprising:
   - a rotary body fixedly supporting at least one motor vehicle model;
   - a background scenery disk arranged coaxially with said rotary body and spaced axially therefrom for rotation independently of the rotary body;
   - a transparent road image forming means represented on said background scenery disk and surrounding the center of rotation of said disk in a closed loop, said road image forming means being non-circular in shape;
   - a screen;
   - a light source for projecting on said screen the image of road represented on said disk and of motor vehicle models; and
   - drive means for rotating said disk and said rotary body.

2. A game machine wherein images of a road and motor vehicles running thereover can be formed on a screen, comprising:
   - a rotary body supporting at least one motor vehicle model;
   - a background scenery disk arranged coaxially with said rotary body and spaced axially therefrom for rotation independently of the rotary member;
   - a transparent road image forming means represented on said background scenery disk and surrounding the center of rotation of said disk in a closed loop;

means for moving the motor vehicle models supported by said rotary body relative to one another width-wise of the road image forming means;

a screen;

a light source for projecting on said screen the images of road represented on said disk and of the motor vehicle models; and drive means for rotating said disk and said rotary body.

3. A game machine wherein images of a road and motor vehicles running thereover can be formed on a screen, comprising:

a rotary body including a rotary member and motor vehicle model support members incapable of rotation relative to said rotary member and movable radially of the center of rotation thereof;

a background scenery disk arranged coaxially with said rotary body and spaced axially therefrom for rotation independently thereof;

a transparent road image forming means represented on said background scenery disk and surrounding the center of rotation of said disk in a cloud loop;

means for moving the motor vehicle models relative to one another widthwise of the road image forming means within the widthwise spacing thereof;

a screen;

a light source for projecting on said screen the images of road represented on said disk and of the motor vehicle models; and drive means for rotating said disk and said rotary body.

4. A game machine as claimed in claim 3, wherein said means for moving the motor vehicle models widthwise of the road image forming means comprises a cam plate mounted coaxially with said background scenery disk and fixed in place in a position axially spaced from the background scenery disk toward the motor vehicle model support members, and cam followers adapted to track said cam plate and each connected to a portion of one of said motor vehicle model support members.

5. A game machine as claimed in claim 4, wherein said road image forming means represented on said background scenery disk is not circular in shape and is curved in different curvatures at different portions thereof, said road forming means and said cam plate being dissimilar in shape.

6. A game machine as claimed in claim 3, wherein said road image forming means represented on said background scenery disk is circular in shape.

7. A game machine as claimed in claim 3, said drive means comprises a first electric motor for driving said rotary body supporting said motor vehicle models adapted to be rendered operative upon actuation of a main switch of the machine, and a second electric motor for driving said background scenery disk adapted to be rendered operative upon depression of a pedal.

8. A game machine as calimed in claim 7, wherein said rotary body is secured to the forward end of a shaft of the first electric motor for driving said rotary body, a first gear is rotatably mounted in an intermediate portion of said shaft, said first gear having secured thereto said background scenery disk, and a second gear secured to a shaft of the second electric motor is in meshing engagement with said first gear.

9. A game machine as claimed in calim 3, wherein said background scenery disk includes an upstanding mountain-shaped wall portion disposed vertically on the rim of the disk.

10. A game machine wherein images of a road and motor vehicles running thereover can be formed on a screen, comprising:

a rotary body including a rotary member and motor vehicle model support members rotatably mounted on said rotary member in a position which is radially displaced from the center of rotation of the rotary member;

a background scenery disk arranged coaxially with said rotary body and spaced axially therefrom for rotation independently thereof;

a transparent road image forming means represented on said background scenery disk and surrounding the center of rotation of said disk in a closed loop;

means for moving the motor vehicle models relative to one another widthwise of the road image forming means within the widthwise spacing thereof;

a screen;

a light source for projecting on said screen the images of road represented on said disk and of the motor vehicle; and drive means for rotating said disk and said rotary body.

* * * * *